US007500799B2

(12) United States Patent
Holloway

(10) Patent No.: US 7,500,799 B2
(45) Date of Patent: Mar. 10, 2009

(54) COSMETIC DISPENSER WITH FRICTIONAL SWIVEL ACTION

(75) Inventor: Thomas F. Holloway, Southbury, CT (US)

(73) Assignee: HCP Packaging USA, Inc., Shelton, CT (US)

( * ) Notice: Subject to any disclaimer, the term of this patent is extended or adjusted under 35 U.S.C. 154(b) by 502 days.

(21) Appl. No.: 11/167,047

(22) Filed: Jun. 24, 2005

(65) Prior Publication Data

US 2006/0291949 A1 Dec. 28, 2006

(51) Int. Cl.
*A45D 40/04* (2006.01)

(52) U.S. Cl. ..... 401/174; 401/74; 401/75; 401/80

(58) Field of Classification Search ..... 401/74, 401/75, 76, 78, 80, 172, 174
See application file for complete search history.

(56) References Cited

U.S. PATENT DOCUMENTS 2,815,122 A 12/1957 Lerner et al.
5,172,993 A * 12/1992 Ackermann et al. ..... 401/69
5,186,560 A 2/1993 Holloway
5,186,561 A 2/1993 Ackermann et al.
5,324,126 A 6/1994 Holloway et al.
5,348,410 A 9/1994 Shozi et al.
5,791,799 A 8/1998 Oehlhorn
5,851,078 A 12/1998 Bow et al.
6,200,047 B1 * 3/2001 Holloway ..... 401/75
6,200,049 B1 3/2001 Pinhel et al.
6,231,254 B1 * 5/2001 Holloway ..... 401/69
6,412,999 B1 7/2002 Pierpont
6,543,953 B1 4/2003 Kim

* cited by examiner

*Primary Examiner*—David J Walczak
(74) *Attorney, Agent, or Firm*—O'Connell Law Firm

(57) ABSTRACT

A cosmetic dispenser for producing an axial movement of a cosmetic between extended and retracted dispositions. A cam member is rotatably engaged with an adapter member in a mating relationship. An elevator member with a cosmetic retaining portion and an elevator rod move axially in response to a rotation of the cam member in relation to the adapter member. A proximal end of the elevator rod can be received through an elevator aperture in the adapter member to enable a sliding of lugs on the elevator rod along a helical thread of the cam member. Frictional drag between the cam member and the adapter member can be produced by one or more drag protuberances therebetween. Where the drag protuberances project from the adapter member, a thin wall portion therein can enable a resilient deflection of the drag protuberances.

25 Claims, 5 Drawing Sheets

COSMETIC DISPENSER WITH FRICTIONAL SWIVEL ACTION

FIELD OF THE INVENTION

The present invention relates generally to cosmetic containers and dispensers. Stated more particularly, disclosed herein is a cosmetic containing and dispensing arrangement demonstrating smooth swiveling action by a frictional engagement between relatively moveable components.

BACKGROUND OF THE INVENTION

In a typical prior art lipstick dispenser, an elevator cup retains a body of lipstick for axial extension and retraction by a swiveling of a base portion in relation to a body portion of the dispenser. Dispensers have commonly employed a cam member with helical threads formed therealong that is rotatably associated with a tubular innerbody that has one or more longitudinal tracks formed therein. The elevator cup typically has one or more lugs received through the longitudinal track and associated with the helical threads of the cam member. Under this arrangement, a rotation of the cam member in relation to the tubular innerbody induces the desired axial movement of the elevator cup and the retained body of lipstick as the lug or lugs of the elevator cup slide along the helical threads and the longitudinal track.

This basic lipstick dispensing design has demonstrated plural disadvantages that have been well recognized in the cosmetic industry. For example, there can be axial and radial looseness between the various components of the lipstick dispenser that can lead to a perceived lack of quality of the device and, by inference, the retained product. The lipstick product can also be perceived as being inferior when the swivel torque required to operate the dispenser is excessively light or inconsistent. Still further, a loosely retained elevator cup can wobble thereby resulting in damage to the product, which again would be likely to reduce the perceived quality thereof.

Conversely, it has been found that a lipstick mechanism with a smooth feel and with consistent torque characteristics lends a perception of quality to the device with a resultant increase in the perceived value of the product. A frictional drag of sufficient significance imparts a firm feel to the device that gives an impression of luxury. Preferably, the frictional drag will remain generally constant during extension and retraction of the lipstick and without regard to whether the dispenser is substantially full or substantially exhausted of cosmetic.

The prior art has attempted numerous arrangements for meeting these needs and goals. In one construction, tabs project radially from the innerbody to provide a frictional engagement with the cam member. That frictional engagement is intended to provide the dispenser with the desired braking effect and constant swivel torque. Other arrangements have produced a similar frictional engagement by the introduction of fins or ribs on the innerbody. It has been found, however, that the tabs and ribs can plastically deform over time thereby losing effectiveness. Furthermore, such constructions consume significant materials and can be considered rather complex in manufacture. Still further, such arrangements can yield an inconsistent swivel torque during travel of the elevator cup since the effective diameter of the components can vary along their length thereby changing the frictional drag in an undesirable manner.

Another problem exhibited by many prior art lipstick dispensers is an unintentional retraction of the elevator cup during use of the dispenser. In such a situation, the force necessary to apply the lipstick tends to drive the elevator cup toward a retracted position as the lugs slide down the helical threads of the cam member. This retraction has been prevented by the provision of a lateral locking track at the distal end of the innerbody longitudinal track. However, when the dispenser is anything other than fully extended, the locking track is inoperative.

Based on the state of the art as summarized above, it becomes clear that there remains a need for an improved cosmetic dispenser that overcomes the difficulties that have been demonstrated by devices of the prior art while providing additional, heretofore unrealized advantages thereover.

SUMMARY OF THE INVENTION

Advantageously, the present invention is founded on the broadly stated object of providing a dispenser for cosmetics, such as lipsticks, that overcomes the disadvantages from which the prior art has suffered while achieving further previously unrealized advantages thereover.

A more particular object of embodiments of the invention is to provide a cosmetic dispenser that extends and retracts a cosmetic smoothly and with consistent swivel torque characteristics.

Another object of embodiments of the invention is to provide a cosmetic dispenser that demonstrates a frictional drag during operation of the dispenser to impart a firm feel to the user.

A further object of embodiments of the invention is to provide a cosmetic dispenser that minimizes perceptible looseness and play between components.

A resultant object of embodiments of the invention is to provide a cosmetic dispenser that provides an impression of quality and luxury to the user.

Still another object of embodiments of the invention is to provide a cosmetic dispenser that conserves materials and is relatively efficient in construction, assembly, and operation.

These and further objects and advantages of embodiments of the invention will become obvious not only to one who reviews the present specification and drawings but also to one who has an opportunity to make use of an embodiment of the cosmetic dispenser disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth the aforementioned objects, a basic embodiment of the present invention for a cosmetic dispenser comprises a cam member, an adapter member with an open inner volume for receiving a distal portion of the cam member in a relatively rotatable, mating relationship, and an elevator member with a cosmetic retaining portion and an elevator rod. A means can be provided for producing an axial movement of the elevator member in response to a rotation of the cam member in relation to the adapter member. With the axial movement of the elevator member, the cosmetic retaining portion of the elevator member, and thus a volume of cosmetic, can be manipulated between an extended disposition for enabling application of the cosmetic and a retracted, storage disposition. A shell can envelope the elevator member and the cosmetic when the two are in a retracted disposition.

The adapter member can be tubular with an annular inner wall surface. An elevator aperture can be disposed in a distal end of the adapter member, and a proximal portion of the elevator rod can be received through the elevator aperture and into the cam member. In such an arrangement, the means for producing an axial movement of the elevator member in response to a relative rotation between the cam member and the adapter member can take the form of at least one helical thread disposed on the cam member, such as along an inner annular surface thereof, in combination with a means, such as one or more lugs adjacent to the proximal end of the elevator rod, for engaging the elevator rod with the at least one helical thread.

To promote the ability of the helical thread or threads to induce an extension and retraction of the elevator rod, a means can be provided for preventing a rotation of the elevator rod in relation to the adapter member such that the lug or lugs will slide along the helical thread or threads during a rotation of the cam member in relation to the adapter member. In one example of the invention, that means could comprise a formation of the elevator rod and the elevator aperture with noncircular cross sections, which could be similar or different. In one presently contemplated embodiment, the elevator rod and the elevator aperture can each have a generally rectangular cross section, possibly with rounded end portions.

To provide the desired firm, luxurious feel during operation of the cosmetic dispenser, embodiments of the invention can incorporate a means for inducing frictional drag between the cam member and the adapter member during a rotation therebetween. The inner diameter of the adapter member can be greater than the outer diameter of the cam member by a diametrical difference, and at least one drag protuberance can be interposed between the inner diameter of the adapter member and the outer diameter of the cam member. The drag protuberance or protuberances can produce an effective change in diameter greater than the diametrical difference between the inner diameter of the adapter member and the outer diameter of the cam member such that the drag protuberance or protuberances will induce a frictional engagement between the cam member and the adapter member.

The drag protuberance or protuberances can project from the outer wall surface of the cam member or from the inner wall surface of the wall of the adapter member. Alternatively, one or more drag protuberances can project from the outer wall surface of the cam member while one or more drag protuberances can project from the inner wall surface of the adapter member. Where the at least one drag protuberance projects from the inner wall surface of the wall of the adapter member, the effective change in diameter can comprise a reduced effective diameter of the adapter member. Under such arrangements, the drag protuberance or protuberances will tend to slide along the same portion of wall surface as the cam member is rotated in relation to the adapter member thereby creating a consistent frictional drag.

To better enable the cam member and the adapter member to be engaged in a mating relationship and to enable a control of the torque required to produce a relative rotation therebetween, the wall of the adapter member, or possibly the cam member, can be resiliently deflectable in proximity to the at least one drag protuberance. In one manifestation of the invention, for example, the wall of the adapter member can have a thin wall area in proximity to the at least one drag protuberance that is sufficiently thin to permit a resilient deflection of the at least one drag protuberance. The thin wall area can at least partially overlap, possibly by substantially surrounding, the at least one drag protuberance. A wall area of the adapter member outside of the thin wall area can be thicker than the thin wall area such that it is substantially inflexible and rigid.

The number of drag protuberances can vary within the scope of the invention. A single drag protuberance could be provided. Alternatively, first and second drag protuberances, which could be disposed in general opposition, can be employed. In still other constructions, three or more drag protuberances, which could possibly be evenly disposed to ensure a concentric reduced effective diameter, can be interposed between the cam member and the adapter member. A thin wall area to enable a resilient deflection can be disposed in proximity to one, some, or all drag protuberances.

To promote the ability of the drag protuberance or protuberances to deflect, at least the thin wall area of the adapter member and possibly the entire adapter member can be formed from a resiliently deflectable material. While numerous different materials are within the scope of the invention, one presently contemplated material comprises polyoxymethylene or POM. The cam member can be formed from the same material as the adapter member or from a different material. In one construction, the cam member can be formed from a rigid polymeric material, such as acrylonitrile butadiene styrene or ABS.

Additional protuberances can be interposed between the inner surface of the adapter member and the outer surface of the cam member that do not have a resiliently deflectable wall portion associated therewith. Such protuberances, which can be termed centering protuberances, can project radially inwardly from, for example, the adapter member a lesser distance than the drag protuberances to establish what can be termed a centering diameter. The centering diameter can be less than the inner diameter of the adapter member but greater than the reduced effective diameter created by the drag protuberances. In certain cases, the centering diameter can be slightly less than the outside diameter of the cam member to produce frictional drag. Alternatively, the centering diameter can be equal to or greater than the outside diameter of the cam member such that the centering protuberances will reduce play between the cam member and the adapter member while not tending to create substantial frictional drag therebetween.

With a plurality of embodiments of the present invention for a cosmetic dispenser summarily described, one will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a cosmetic dispenser with frictional swivel action is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
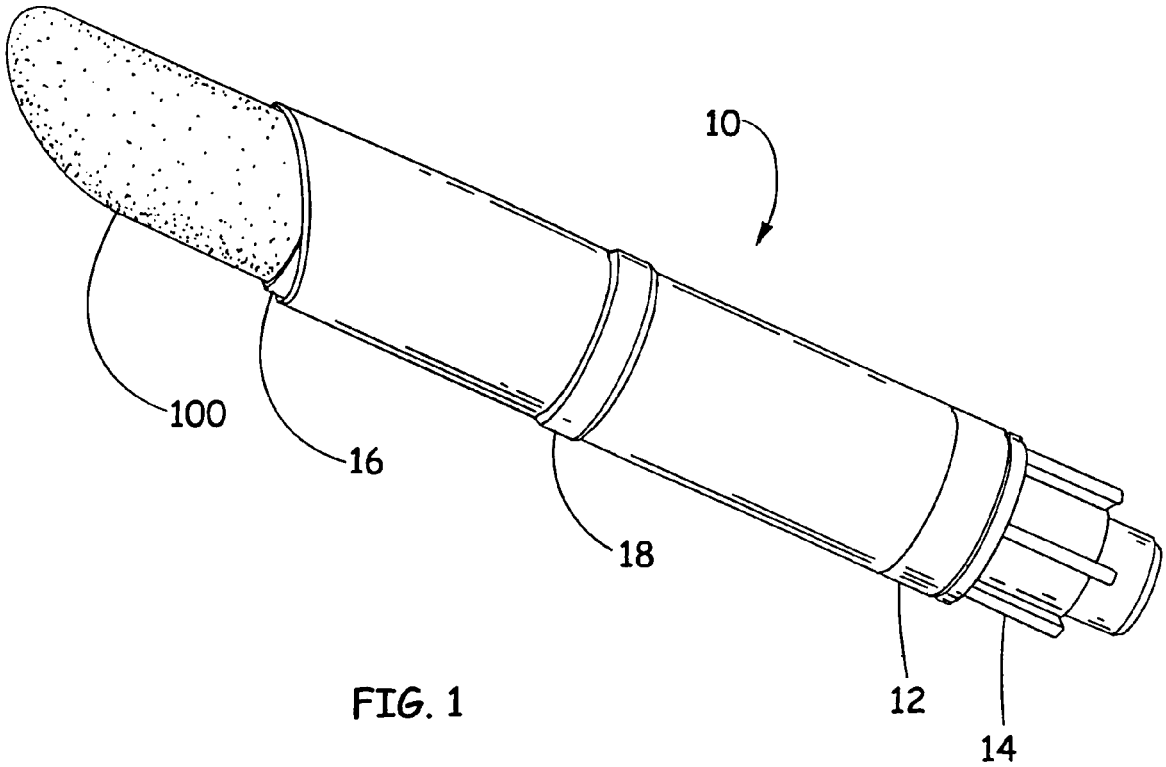
FIG. 1 is a perspective view of a cosmetic dispenser with frictional swivel action according to the present invention.

With this in mind and looking more particularly to the accompanying figures, a first exemplary embodiment of a cosmetic dispenser pursuant to the present invention is indicated generally at 10 in FIG. 1. The cosmetic dispenser 10 includes an adapter member 12 that is rotatably engaged with a cam member 14. The cam member 14 and the adapter member 12 cooperate to produce an axial movement of an elevator member 16, which is employed to retain a member of lipstick 100, between the extended disposition depicted in FIG. 2 and the retracted disposition depicted in FIG. 3. A tubular shell 18 can substantially house the elevator member 16.

For ease of reference, the cosmetic dispenser 10 can be considered to have a proximal end defined by the base of the cam member 14 while the tip of the tubular shell 18 can be considered to define a distal end of the cosmetic dispenser 10. Each component of the cosmetic dispenser 10 can be described under that convention. It should be noted that, while the term member is employed in relation to the adapter member 12, the cam member 14, and the elevator member 16, each could be formed unitarily as a single piece of material or from multiple subcomponents joined by any effective method to form the respective structure. Just as clearly, except as otherwise described or claimed, the adapter member 12, the cam member 14, the elevator member 16, and the tubular shell 18 can be formed from any suitable material and by any effective method.

A greater understanding of the adapter member 12 can be had by reference to FIGS. 4 through 7 where it is shown apart from the remainder of the cosmetic dispenser 10. The adapter member 12 has a generally cylindrical body 20 with an open inner volume. The cylindrical body 20 of the adapter member 12 can have an open proximal end. A distal end of the cylindrical body 20 can be closed except for a concentrically disposed elevator aperture 22.

Figure 13:
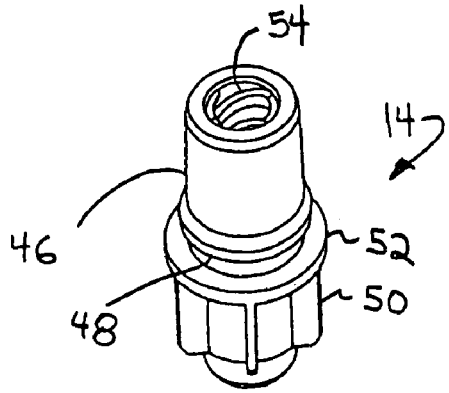
FIG. 13 is a perspective view of a cam member under the instant invention.
Figure 14:
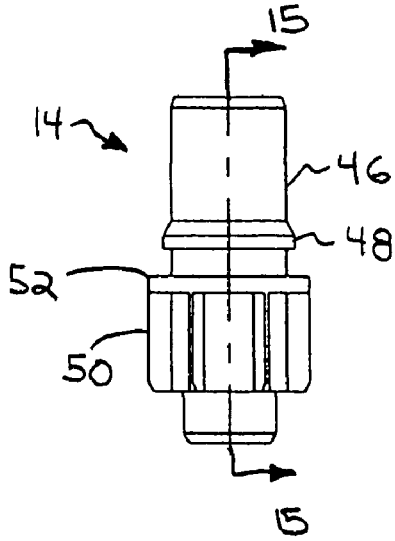
FIG. 14 is a view in side elevation of the cam member of FIG. 13.
Figure 15:
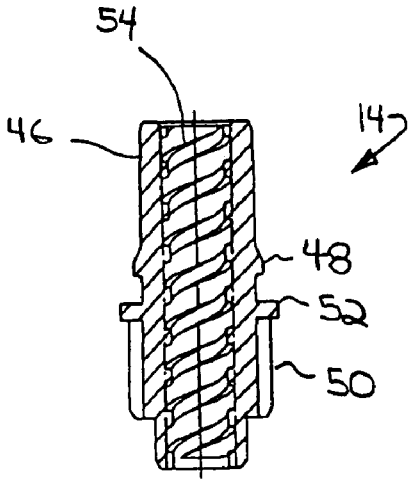
FIG. 15 is a cross section of the cam member taken along the line 15-15 in FIG. 14.

The cam member 14, which is shown alone in FIGS. 13 through 15, has a generally tubular body 46 with a distal portion sized to be received into the open inner volume of the adapter member 12 with sufficient clearance to allow a relative rotation therebetween. The cam member 14 has an annular shoulder 52 extending from the tubular body 46. The annular shoulder 52 in this embodiment has an outer diameter that approximates the outer diameter of the adapter member 12 and is spaced from a distal end of the cam member 14 by a distance slightly greater than a depth of the adapter member 12 from the proximal end thereof to the proximal surface of the closed distal end thereof. With this, the distal portion of the cam member 14 beyond the shoulder 52 can be received into the open inner volume of the adapter member 12 in a mating relationship.

The adapter member 12 and the cam member 14 can be rotatably retained in relation to one another. In the present example, a means for retaining the adapter member 12 in relation to the cam member 14 comprises an annular retaining ridge 48 that rings the outer surface of the distal portion of the cam member 14 and engages an annular furrow 30 formed along an inner diameter of the adapter member 12. Under this arrangement, the adapter member 12 and the cam member 14 can be rotatably coupled by a mechanical engagement between the retaining ridge 48 and the furrow 30. Of course, the retaining ridge 48 and the furrow 30 could be oppositely disposed. It will also be noted that numerous other means for accomplishing such a rotatable coupling would readily occur to one skilled in the art after reading this disclosure.

The cam member 14 can have a plurality of radially communicating fins 50 projecting from a proximal portion thereof for enabling an actuation of the cosmetic dispenser 10 as will be described below. Additionally, the inner annular wall of the cam member 14 can have one or more helical threads 54 disposed therealong for conveying the elevator member 16 as will also be elaborated upon below. The fins 50 and the helical threads 54 can be integrally formed with the tubular body 46 or can be fixed or coupled thereto.

Figure 11:
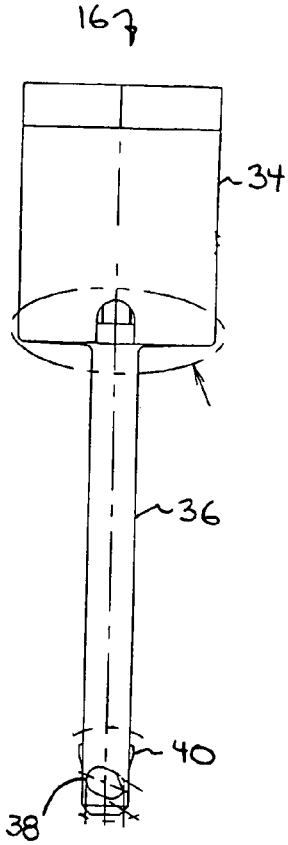
FIG. 11 is a view in side elevation of the elevator member.
Figure 12:
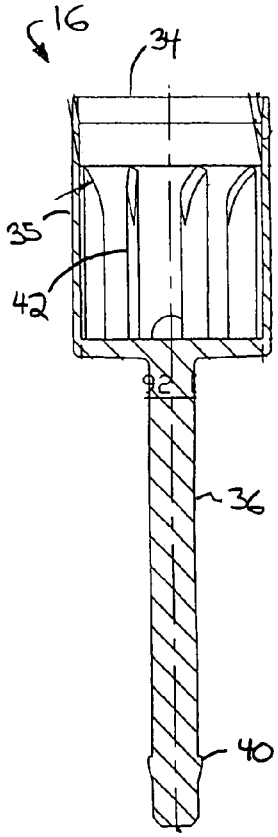
FIG. 12 is a cross section of the elevator member taken along the line 12-12 in FIG. 10.

The elevator member 16, which is shown apart from the remaining components of the cosmetic dispenser 10 in FIGS. 8 through 12, comprises an elevator rod 36 with a distal end fixed to an elevator cup 34. The elevator cup 34 has an open inner volume for retaining a proximal end portion of the member of lipstick 100. The open inner volume is defined by an annular peripheral wall 35 and a cup base 44. A plurality of resiliently deflectable fins 42 project radially inward from the peripheral wall 35 in an angled relationship relative to tangents of the annular peripheral wall 35. As FIG. 12 shows most clearly, the fins 42 can have a distal taper for enabling a most efficient receipt of the member of lipstick 100. The fins 42 are longitudinally aligned with the elevator member 16 such that the fins 42 can deflect to receive and resiliently engage the member of lipstick 100.

One or more elevator lugs 38 can project from the elevator rod 36 for engaging the helical thread or threads 54 of the cam member 14. In the depicted example, first and second elevator lugs 38 project from opposed sides of the elevator rod 36 adjacent to the proximal end thereof. As FIG. 11 shows, the lugs 38 can have proximal and distal surfaces angled to match a pitch angle of the helical thread or threads 54. In operation, when the cam member 14 is rotated in relation to the adapter member 12, the elevator lug or lugs 38 slide along the helical thread or threads 54 of the cam member 14 to yield and axial movement of the elevator member 16. Whether the axial movement of the elevator member 16 comprises an extension or a retraction will depend on the angular direction of the thread or threads 54 and the rotational direction of the cam member 14 in relation to the adapter member 12.

Relative rotation between the elevator member 16 and the adapter member 12 can be prevented to facilitate the sliding of the elevator lug or lugs 38 along the thread or threads 54. Numerous effective methods and means will readily occur to one skilled in the art after reading this disclosure with each such method and means being within the scope of the present invention. In certain constructions, relative rotation can be prevented by forming the elevator rod 36 of the elevator member 16 and the elevator aperture 22 of the adapter member 12 with noncircular cross sections, which can be similar or different. In the present case, the elevator rod 36 and the elevator aperture 22 have generally rectangular cross sections with straight sides and rounded ends.

The lugs 38 can project in opposing directions from opposed, narrower sides of the elevator rod 36. Also, one or more stop protuberances 40 can project from the elevator rod 36 adjacent to the proximal end thereof but distal to the lugs 38. The retaining protuberances 40 can project in opposing directions from the opposed, broader cross-sectional dimension of the elevator rod 36 to be wider than the distance between the corresponding opposed, broader sides of the elevator aperture 22. Under this arrangement, the retaining protuberances 40 prevent an overextension of the elevator member 16 while remaining clear of the helical thread or threads 54 of the cam member 14 as the lugs 38 will intermesh with the helical thread or threads 54.

The proximal end of the elevator rod 36 can be chamfered as can be the distal surface of the elevator aperture 22 to facilitate an insertion of the elevator rod 36 into and through the elevator aperture 22. Further, one or both of the opposed, broader sides of the elevator aperture 22 can be flexible to enable the insertion of the proximal end of the elevator rod 36 through the elevator aperture 22 without damage to the retaining protuberances 40. In the present example, both of the opposed, broader sides of the elevator aperture 22 are rendered flexible by being formed with flexible tongue portions 27. The flexible tongue portions 27 are formed by the formation of a concave area 29 on the underside of the distal end portion of the adapter member 12. Other arrangements for rendering the opposed sides of the elevator aperture 22 flexible are possible and within the scope of the invention.

The tubular shell 18 can have a proximal end engaged with the adapter member 12 and can be constructed to encase substantially the entire member of lipstick 100 when the elevator member 16 is in a retracted disposition and to allow substantially the entire member of lipstick 100 to project beyond a distal end of the tubular shell 18 when the elevator member 16 is in an extended disposition. The proximal end of the tubular shell 18 can be perpendicular to the axis of the tubular shell 18 while the distal end of the tubular shell 18 can also be perpendicular to the axis of the tubular shell 18 or mitered as in FIGS. 1 through 3. The inner diameter of the tubular shell 18 and the outer diameter of the distal portion of the adapter member 12 can be sized for a close or frictional engagement therebetween. The tubular shell 18 can be seated on a shoulder 32 on the adapter member 12.

Figure 2:
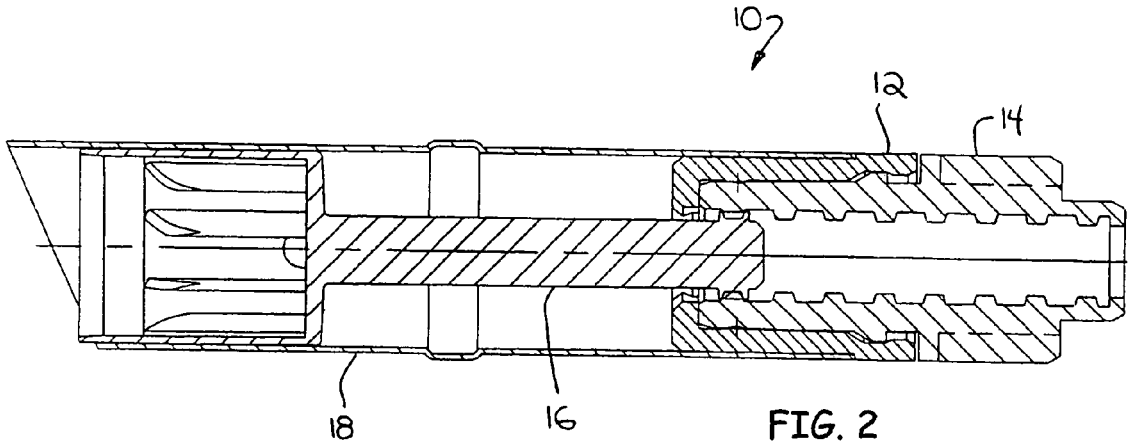
FIG. 2 is a cross section of the cosmetic dispenser of FIG. 1 taken along the line 2-2 in an extended disposition.
Figure 3:
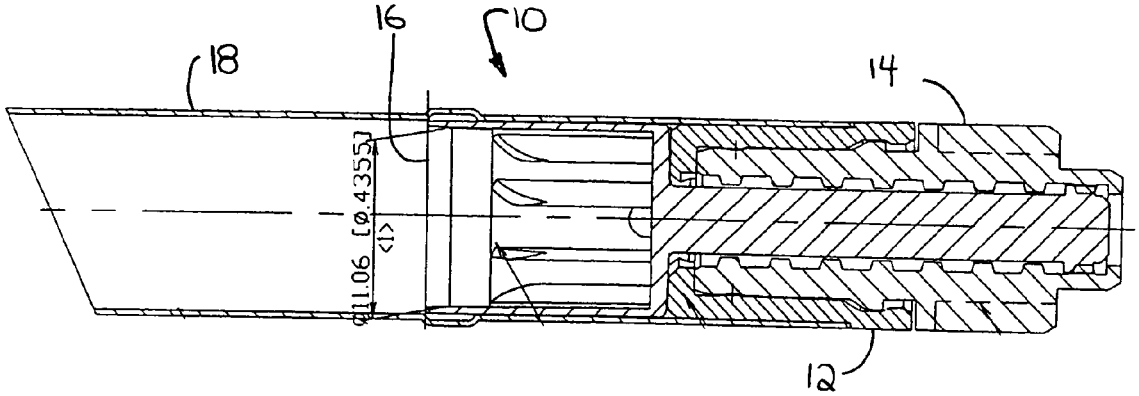
FIG. 3 is a cross section of the cosmetic dispenser of FIG. 1 taken along the line 2-2 in a retracted disposition.
Figure 4:
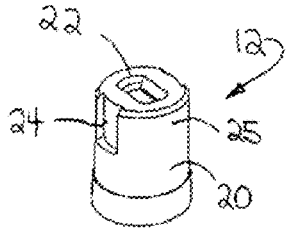
FIG. 4 is a perspective view of an adaptor member pursuant to present invention.
Figure 5:
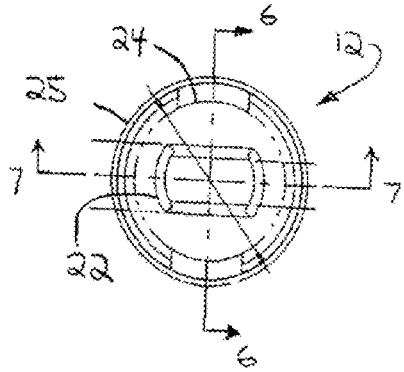
FIG. 5 is a top plan view of the adaptor member of FIG. 4.

With the cosmetic dispenser 10 fully assembled, the elevator cup 34, and thus a member of lipstick 100, can be manipulated between the extended configuration depicted in FIG. 2 and the retracted configuration depicted in FIG. 3 by a rotation of the cam member 14 in relation to the adapter member 12. To do so, a user could begin by removing a frictionally retained cap (not shown) from the tubular shell 18 of the cosmetic dispenser 10. The user could then grip the cam member 14, such as by gripping the fins 50 with a first hand, and then engage the adapter member 12 either directly or by use of the tubular shell 18, such as with a second hand. Next, torque sufficient to rotate the cam member 14 in relation to the adapter member 12 can be applied. As the cam member 14 is rotated, the elevator member 16 will be prevented from rotating in relation to the adapter 12 by virtue of the relative cross sections of the elevator rod 36 and the elevator aperture 22. With that, the lugs 38 will slide along the helical thread or threads 54 to yield an axial movement of the elevator cup 34 and the member of lipstick 100. Relative rotation in a first direction will induce extension while relative rotation in a second, opposite direction will induce a retraction of the elevator cup 34 and the member of lipstick 100.

As noted previously, a cosmetic dispenser that extends and retracts smoothly and with consistent torque characteristics, such as by the provision of frictional drag, tends to impart a firm and luxurious feel to the user that gives the perception of quality as to the cosmetic dispenser and the product retained thereby. The present invention can incorporate a means for inducing a frictional drag between the cam member 14 and the adapter member 12 to provide the desired torque characteristics.

Figure 6:
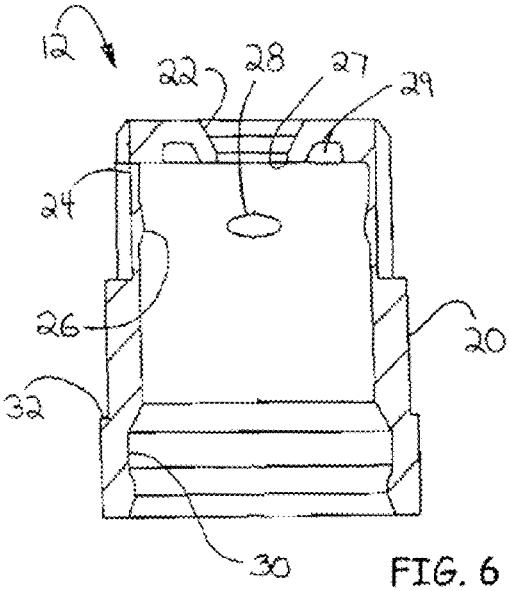
FIG. 6 is a cross section of the adaptor member taken along the line 6-6 in FIG. 5.
Figure 7:
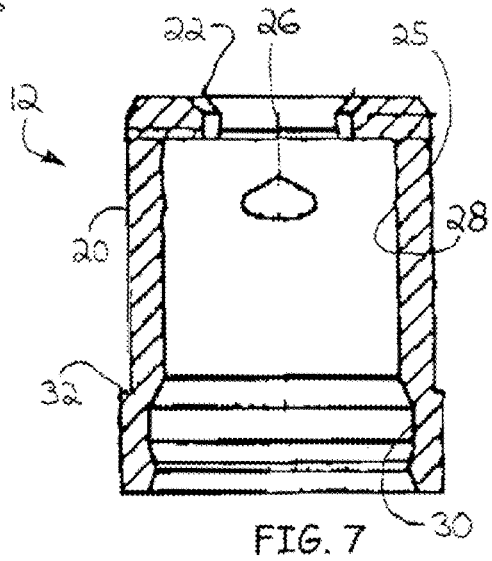
FIG. 7 is a cross section of the adaptor member taken along the line 7-7 in FIG. 5.
Figure 8:
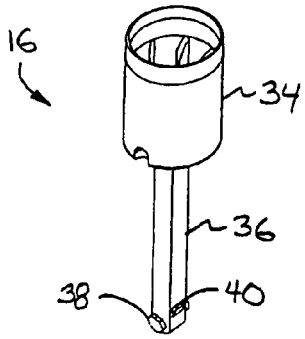
FIG. 8 is a perspective view of an elevator member pursuant to the invention disclosed herein.
Figure 9:
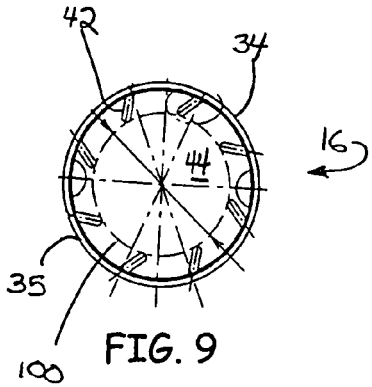
FIG. 9 is a top plan view of the elevator member of FIG. 8.
Figure 10:
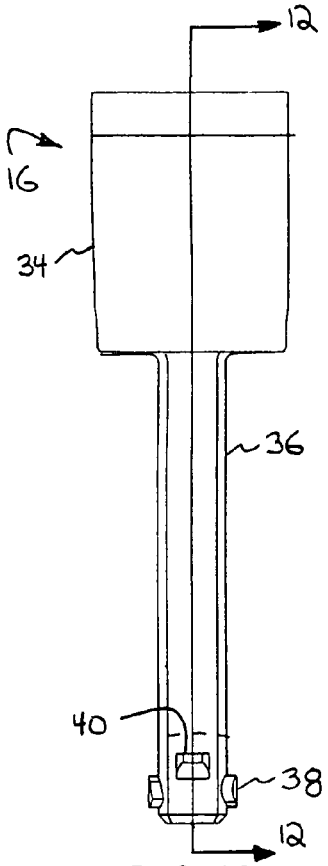
FIG. 10 is a view in front elevation of the elevator member.

Taking FIGS. 1 and 2 in combination with FIGS. 6 and 7, one sees that the body portion 46 of the cam member 14 can have an outer diameter just slightly less than the inner diameter of the adapter member 12 thereby to provide a rotational clearance but with a marginal spacing therebetween. To produce frictional drag, one or more drag protuberances 26 project radially inwardly from the inner wall of the adapter member 12 to produce a reduced effective diameter that is less than the outer diameter of the body portion of the cam member 14 when the members 12 and 14 are separate. As a result, frictional contact is created between the adapter member 12 and the cam member 14 when the members 12 and 14 are joined as shown in FIGS. 2 and 3. The reduced effective diameter can be between a single drag protuberance 26 and an opposing portion of the inner wall surface of the adapter member 12, between opposed drag protuberances 26 as depicted in the present embodiment, or by further drag protuberances 26 establishing an overall reduced effective diameter or multiple, likely identical, reduced effective diameters. With this, the drag protuberance or protuberances 26 will interfere with the rotation of the cam member 14 in relation to the adapter member 12 to require an increased torque to produce rotation.

The adapter member 12 can have a thinned wall portion 24 that overlaps and possibly surrounds one, both, or all of the drag protuberance or protuberances 26. Each thinned wall portion 24 and possibly the entire adapter member 12 can be formed from a deflectable material, preferably a resiliently deflectable material. With this, the drag protuberance or protuberances 26 can deflect to accommodate the outside diameter of the body portion 46 of the cam member 14. Since the adapter member 12 and the cam member 14 do not move axially in relation to one another, the protuberance or protuberances 26 travel radially over the same portion of the smooth outer surface of the cam member 14. As a result, the frictional drag will be smooth and substantially constant, which represents an improvement over many cosmetic dispensers of the prior art. Furthermore, the amount of frictional drag can be controlled by a calibration of, among other things, the thickness of the thinned wall portion 24, the difference between the reduced effective diameter and the outside diameter of the cam member 14, and the materials from which the cam member 14 and the adapter member 12 are formed.

Additional protuberances 28 can be interposed between the inner surface of the adapter member 12 and the outer surface of the cam member 14 without having a resiliently deflectable wall portion 24 associated therewith. Such protuberances 28, which can be termed centering protuberances 28, can project radially inwardly from, for example, the adapter member 12 a lesser distance than the drag protuberances 26 to establish what can be termed a centering diameter. The centering diameter can be less than the inner diameter of the adapter member 12 but greater than the reduced effective diameter created by the drag protuberances 26. In certain cases, the centering diameter can be slightly less than the outside diameter of the cam member 14 to produce frictional drag. Alternatively, the centering diameter can be equal to or greater than the outside diameter of the cam member 14 such that the centering protuberances will reduce play between the cam member 14 and the adapter member 12 while not tending to create substantial frictional drag therebetween. The centering diameter can be between a single centering protuberance 28 and an opposing portion of the inner wall of the adapter member 12, between opposed centering protuberances 28 as depicted in the present embodiment, or between further centering protuberances 28 establishing a general reduced effective diameter or multiple, likely identical, centering diameters.

It will, of course, be appreciated that the dimensions of the components of the cosmetic dispenser 10 could vary within the scope of the invention. Nonetheless, the description of dimensions in relation to one potential embodiment of the cosmetic dispenser 10 may assist in a better understanding of the invention. For convenience, reasonable tolerances will be assumed. It will be noted that the particular dimensions and dimensional relations will vary depending on the needs and goals of the manufacturer and on the materials from which the components are formed.

In one construction, the distal portion of the cam member 14 can have an outside diameter of 8.99 mm (0.354 inches) while the adapter member 12 can have an inside diameter of 9.14 mm (0.360 inches) thereby leaving a difference in diameters of 0.15 mm (0.006 inches). The opposed centering protuberances 28 can each project 0.05 mm (0.001 inches) to cooperate to produce a centering diameter of 9.04 mm (0.356 inches), which leaves a slight clearance in relation to the outside diameter of the cam member 14. However, the opposed drag protuberances 26 can each project 0.165 mm (0.0065 inches) such that they would cooperate to produce a reduced effective diameter of 8.81 mm (0.347 inches), which is 0.18 mm (0.007 inches) smaller than the outside diameter of the cam member 14.

By virtue of the thinned wall portion 24 and the formation of the thinned wall portion 24 from a deflectable, possibly resiliently deflectable, material, the drag protuberances 26 can deflect to extend the reduced effective diameter to accommodate the outer diameter of the cam member 14, which can be smooth. With that, the drag protuberances 26 will press on the outer surface of the cam member 14 and will exert a frictional drag during a rotation of the adapter member 12 in relation to the cam member 14. In one example of the adapter member 12, the wall 25 can have a general thickness of 1.42 mm (0.056 inches). The thinned wall portion 24 can be sufficiently thin to permit the resiliency and frictional drag contemplated herein. By way of example, the thinned wall portion 24 can have a thickness between approximately 0.15 mm (0.006 inches) and 0.76 mm (0.030 inches).

It will again be noted that the components of the cosmetic dispenser 10 could be formed form numerous different materials. In one presently contemplated embodiment, the cam member 14 can be formed from a rigid material to ensure that it retains its form and to prevent failure of the threads 54 and fins 50. The rigid material can, for example, comprise a rigid thermoplastic, such as acrylonitrile butadiene styrene or ABS. It has been found that the drag protuberances 26, the thinned wall portion 24, and possibly the entire adapter member 12 can be formed from a different thermoplastic, such as polyoxymethylene or POM, which can be advantageous for, among other things, its abrasion resistance, dimensional stability, excellent resilience, and low friction characteristics due to what has been termed a natural self-lubrication. For the same reasons, the elevator member 16 can also be formed from a rigid thermoplastic, which again can comprise POM. The tubular shell 18 can be formed from a metal, such as aluminum.

By forming the cam member 14 and the adapter member 12 from different materials, such as ABS and POM respectively, it has been discovered that the components can be rotated in relation to each other with minimal or no start up friction but with the desired frictional drag being present as the drag protuberances 28 slide along the outer surface of the cam member 14. Because the drag protuberances 28 slide over the same portion of the cam member 14, the frictional drag will be highly consistent. The same frictional drag will cause the elevator member 16 and a member of lipstick 100 retained thereby to resist retracting in response to the application of axial force thereto, such as during the application of lipstick.

From the foregoing, it will be clear that the present invention for a cosmetic dispenser 10 has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of Letters Patent:

1. A cosmetic dispenser for producing an axial movement of a volume of cosmetic between an extended disposition and a retracted disposition, the cosmetic dispenser comprising:

a cam member with a proximal portion, a distal portion, and an annular outer wall surface with an outer diameter;

an adapter member with a proximal end, a distal end, a wall with an inner wall surface with an inner diameter, and an open inner volume for receiving the distal portion of the cam member in a relatively rotatable, mating relationship;

an elevator member comprising a cosmetic retaining portion and an elevator rod wherein the elevator rod is retained for axial movement in relation to the adapter member;

a means for producing an axial movement of the elevator member in response to a rotation of the cam member in relation to the adapter member;

a means for inducing frictional drag between the cam member and the adapter member during a rotation therebetween wherein the inner diameter of the adapter member is greater than the outer diameter of the cam member by a diametrical difference, wherein the means for inducing frictional drag between the cam member and the adapter member comprises at least one drag protuberance interposed between the inner diameter of the adapter member and the outer diameter of the cam member wherein the at least one drag protuberance produces an effective change in diameter greater than the diametrical difference between the inner diameter of the adapter member and the outer diameter of the cam member, wherein the at least one drag protuberance projects from the inner wall surface of the wall of the adapter member, wherein the effective change in diameter produces a reduced effective diameter of the adapter member, wherein the wall of the adapter member is resiliently deflectable in proximity to the at least one drag protuberance whereby the at least one drag protuberance can resiliently deflect to enable the cam member to be engaged with the adapter member in a mating relationship and to produce a frictional drag therebetween, wherein the wall of the adapter member has a portion with a general wall thickness, wherein the wall of the adapter member has a thinned wall portion having a smaller area than an area of the portion of the wall having the general wall thickness and that surrounds the at least one drag protuberance, and wherein the thinned wall portion has a thickness that is less than the general wall thickness and that is sufficiently thin to permit a resilient deflection of the at least one drag protuberance.

2. The cosmetic dispenser of claim 1 wherein the adapter member is tubular with an annular inner wall surface, wherein the adapter member has an elevator aperture in the distal end thereof, wherein a proximal portion of the elevator rod is received through the elevator aperture in the adapter member and into the cam member, and wherein the means for producing an axial movement of the elevator member in response to a relative rotation between the cam member and the adapter member comprises at least one helical thread disposed on the cam member in combination with a means for engaging the elevator rod with the at least one helical thread.

3. The cosmetic dispenser of claim 2 wherein the means for engaging the elevator rod with the at least one helical thread comprises at least one lug that projects from the elevator rod for engaging the at least one helical thread of the cam member.

4. The cosmetic dispenser of claim 2 further comprising a means for preventing a rotation of the elevator rod in relation to the adapter member.

5. The cosmetic dispenser of claim 4 wherein the means for preventing a rotation of the elevator rod in relation to the adapter member comprises a formation of the elevator rod and the elevator aperture of the adapter member with noncircular cross sections.

6. The cosmetic dispenser of claim 5 wherein the elevator rod and the elevator aperture of the adapter member each has a generally rectangular cross section.

7. The cosmetic dispenser of claim 5 further comprising at least one retaining protuberance that projects from the elevator rod adjacent to the proximal end of the elevator rod wherein the at least one retaining protuberance is distal to the at least one lug whereby an overextension of the elevator rod is prevented.

8. The cosmetic dispenser of claim 7 wherein the elevator aperture has a flexible portion for enabling an insertion of the proximal end of the elevator rod through the elevator aperture without damage to the at least one retaining protuberance.

9. The cosmetic dispenser of claim 1 wherein the wall of the adapter member with the general wall thickness is substantially inflexible.

10. The cosmetic dispenser of claim 1 wherein there are at least first and second drag protuberances wherein the first and second drag protuberances project in general opposition from the inner wall surface of the wall of the adapter member and wherein a thinned wall portion is disposed in proximity to each of the first and second drag protuberances.

11. The cosmetic dispenser of claim 1 wherein at least the thinned wall portion of the adapter member is formed from a resiliently deflectable material.

12. The cosmetic dispenser of claim 11 wherein at least the thinned wall portion of the adapter member is formed from polyoxymethylene.

13. The cosmetic dispenser of claim 12 wherein the cam member is formed from acrylonitrile butadiene styrene.

14. A cosmetic dispenser for producing an axial movement of a volume of cosmetic between an extended disposition and a retracted disposition, the cosmetic dispenser comprising:

a cam member with a proximal portion and a distal portion and an annular outer wall surface with an outer diameter;

an adapter member with a proximal end, a distal end, a wall with an annular inner wall surface with an inner diameter, and an open inner volume for receiving the distal portion of the cam member in a relatively rotatable, mating relationship;

an elevator member comprising a cosmetic retaining portion and an elevator rod wherein the elevator rod is retained for axial movement in relation to the adapter member;

a means for producing an axial movement of the elevator member in response to a rotation of the cam member in relation to the adapter member;

a means for inducing frictional drag between the cam member and the adapter member during a rotation therebetween wherein the inner diameter of the adapter member is greater than the outer diameter of the cam member by a diametrical difference and wherein the means for inducing frictional drag between the cam member and the adapter member comprises at least first and second drag protuberances interposed between the inner diameter of the adapter member and the outer diameter of the cam member wherein the at least first and second drag protuberances produce an effective change in diameter greater than the diametrical difference between the inner diameter of the adapter member and the outer diameter of the cam member; and at least first and second centering protuberances interposed between the inner diameter of the adapter member and the outer diameter of the cam member wherein the first and second centering protuberances cooperate to produce a centering diameter that is less than the inner diameter of the adapter member but greater than the reduced effective diameter.

15. The cosmetic dispenser of claim 14 wherein the first and second centering protuberances project from the inner wall surface of the wall of the adapter member.

16. A cosmetic dispenser with frictional swivel action for producing an axial movement of a volume of cosmetic between an extended disposition and a retracted disposition, the cosmetic dispenser comprising:

a cam member with a proximal portion and a distal portion with an annular outer surface with an outer diameter;

a tubular adapter member with a proximal end, a distal end with an elevator aperture, a wall with an annular inner wall surface with an inner diameter, and an open inner volume for receiving the distal portion of the cam member in a relatively rotatable, mating relationship wherein the inner diameter of the adapter member is greater than the outer diameter of the cam member by a diametrical difference;

an elevator member comprising a cosmetic retaining portion and an elevator rod received through the elevator aperture in the adapter member and into the cam member for axial movement in relation to the adapter member;

a means for producing an axial movement of the elevator member in response to a rotation of the cam member in relation to the adapter member;

at least one drag protuberance interposed between the inner diameter of the adapter member and the outer diameter of the cam member wherein the at least one drag protuberance produces an effective change in diameter greater than the diametrical difference between the inner diameter of the adapter member and the outer diameter of the cam member thereby to induce frictional drag between the cam member and the adapter member during a rotation therebetween;

at least first and second centering protuberances interposed between the inner diameter of the adapter member and the outer diameter of the cam member wherein the first and second centering protuberances cooperate to produce a centering diameter that is less than the inner diameter of the adapter member but greater than the reduced effective diameter;

wherein the wall of the adapter member is resiliently deflectable in proximity to the at least one drag protuberance whereby the at least one drag protuberance can resiliently deflect to enable the cam member to be engaged with the adapter member in a mating relationship and to produce a frictional drag therebetween.

17. The cosmetic dispenser of claim 16 wherein the at least one drag protuberance projects from the inner wall surface of the wall of the adapter member and wherein the effective change in diameter produces a reduced effective diameter of the adapter member.

18. The cosmetic dispenser of claim 17 wherein the wall of the adapter member has a thin wall area in proximity to the at least one drag protuberance wherein the thin wall area is sufficiently thin to permit a resilient deflection of the at least one drag protuberance.

19. The cosmetic dispenser of claim 18 wherein the thin wall area of the wall of the adapter member at least partially overlaps the at least one drag protuberance.

20. The cosmetic dispenser of claim 19 wherein the thin wall area of the wall of the adapter member substantially surrounds the at least one drag protuberance.

21. The cosmetic dispenser of claim 18 wherein the wall of the adapter member has a wall area outside of the thin wall area that is thicker than the thin wall area and is substantially inflexible.

22. The cosmetic dispenser of claim 18 wherein there are at least first and second drag protuberances wherein the first and second drag protuberances project in general opposition from the inner wall surface of the wall of the adapter member and wherein a thin wall area is disposed in proximity to each of the first and drag protuberances.

23. The cosmetic dispenser of claim 18 wherein at least the thin wall area of the adapter member is formed from a resiliently deflectable material comprising polyoxymethylene.

24. The cosmetic dispenser of claim 23 wherein the cam member is formed from acrylonitrile butadiene styrene.

25. The cosmetic dispenser of claim 16 wherein the means for producing an axial movement of the elevator member in response to a relative rotation between the cam member and the adapter member comprises at least one helical thread disposed on the cam member in combination with at least one lug that projects from the elevator rod for engaging the at least one helical thread of the cam member and further comprising a means for preventing a rotation of the elevator rod in relation to the adapter member.

* * * * *